US010960267B2

(12) United States Patent
Montgomery

(10) Patent No.: US 10,960,267 B2
(45) Date of Patent: Mar. 30, 2021

(54) HIPPOTHERAPY DEVICE

(71) Applicant: Melissa Jo Montgomery, Alexandria, IN (US)

(72) Inventor: Melissa Jo Montgomery, Alexandria, IN (US)

( * ) Notice: Subject to any disclaimer, the term of this patent is extended or adjusted under 35 U.S.C. 154(b) by 482 days.

(21) Appl. No.: 15/094,602

(22) Filed: Apr. 8, 2016

(65) Prior Publication Data

US 2016/0296027 A1 Oct. 13, 2016

Related U.S. Application Data

(60) Provisional application No. 62/145,844, filed on Apr. 10, 2015.

(51) Int. Cl.

| | |
|---|---|
| ***A63B 69/04*** | (2006.01) |
| ***A63B 26/00*** | (2006.01) |
| ***A63B 21/00*** | (2006.01) |
| *A63B 71/00* | (2006.01) |
| *A63B 21/005* | (2006.01) |
| *A63B 71/02* | (2006.01) |

(52) U.S. Cl.

CPC ..... *A63B 26/00* (2013.01); *A63B 21/0004* (2013.01); *A63B 26/003* (2013.01); *A63B 69/04* (2013.01); *A63B 21/0059* (2015.10); *A63B 2071/009* (2013.01); *A63B 2071/0063* (2013.01); *A63B 2071/025* (2013.01); *A63B 2208/0233* (2013.01); *A63B 2225/50* (2013.01)

(58) Field of Classification Search

USPC ..... 434/247; 446/29, 313; 472/95, 98–102, 472/133

See application file for complete search history.

(56) References Cited

U.S. PATENT DOCUMENTS

| | | | | |
|---|---|---|---|---|
| 3,672,075 | A | 6/1972 | Eikelenboom | |
| 4,957,444 | A | 9/1990 | Armen | |
| 5,429,515 | A | 7/1995 | Greenwood | |
| 5,885,080 | A * | 3/1999 | Letovsky | G09B 9/04 434/29 |
| 6,599,198 | B2 | 7/2003 | Ettenhofer | |
| 6,616,456 | B1 | 9/2003 | Nalty et al. | |
| 6,808,458 | B1 | 10/2004 | Jung | |
| 7,175,440 | B1 | 2/2007 | Bateman | |
| 7,347,806 | B2 * | 3/2008 | Nakano | A63B 24/00 434/247 |

(Continued)

FOREIGN PATENT DOCUMENTS

| | | | |
|---|---|---|---|
| DE | 202012102728 | U1 | 8/2012 |
| JP | 4020207 | B2 | 12/2007 |

OTHER PUBLICATIONS

Melissa Montgomery, Senior Design PowerPoint Presentation, Mar. 27, 2013.*

(Continued)

*Primary Examiner* — Kurt Fernstrom
(74) *Attorney, Agent, or Firm* — Indiana University Maurer School of Law IP Legal Clinic

(57) ABSTRACT

A hippotherapy device for supporting a rider comprises a rider mount, which includes ribs and a backbone, a support frame, a drivetrain, and an enclosure. The hippotherapy device is configured to mimic the back of a horse and its undulating motion while a horse is walking.

15 Claims, 14 Drawing Sheets

(56) References Cited

U.S. PATENT DOCUMENTS

| | | | | |
|---|---|---|---|---|
| 7,749,088 | B2 * | 7/2010 | Greenwood | A63B 69/04 434/247 |
| 7,931,565 | B2 * | 4/2011 | Nakano | A63B 69/04 434/247 |
| 8,827,279 | B1 * | 9/2014 | Clark | A63H 17/26 180/210 |
| 8,827,822 | B2 * | 9/2014 | Lee | A63G 31/02 434/55 |
| 8,852,010 | B2 * | 10/2014 | Garner | A63G 19/20 434/247 |
| 9,585,487 | B1 * | 3/2017 | Brown | A61H 1/005 |
| 9,597,573 | B2 * | 3/2017 | Chung | A63B 24/0087 |
| 9,788,659 | B1 * | 10/2017 | Jen | A47C 9/002 |
| 2016/0029596 | A1 * | 2/2016 | Bruegman | A63B 69/0068 119/839 |

OTHER PUBLICATIONS

Melissa Montgomery, Senior Design Presentation Handout, Mar. 27, 2013.*

Melissa Montgomery, Senior Design PowerPoint Presentation, Mar. 27, 2013, 35 pages.

Melissa Montgomery, Senior Design Presentation Handout, Mar. 27, 2013, 2 pages.

* cited by examiner

HIPPOTHERAPY DEVICE

CROSS-REFERENCE TO RELATED APPLICATIONS

The present application claims priority to U.S. Provisional Patent Application Ser. No. 62/145,844 filed on Apr. 10, 2015, and entitled "HIPPOTHERAPY DEVICE," the complete disclosure of which is expressly incorporated by reference herein.

BACKGROUND

The word "hippotherapy" is of Greek origin, meaning "therapy with the assistance of a horse." In particular, hippotherapy is a form of physical, occupational, and/or speech therapy that may provide motor and/or sensory input to a patient. Hippotherapy treatment strategy focuses on the therapeutic benefits from interactions between a rider and a horse. While hippotherapy can benefit several physical and emotional aspects, the method is generally implemented to improve an individual's strength, control, balance, and/or posture through the beneficial motions involved with riding a horse. Further, the method can be applied to increase endurance, motor planning, visual and tactile recognition, coordination, timing, respiratory control, sensory integration, and/or attentiveness. Conditions that can be treated with this type of therapy include lower extremity amputations, cerebral palsy, traumatic brain injury, spinal injury, Down Syndrome, deafness and blindness, autism and/or post-surgery rehabilitation needs. A number of care organizations and recipients cite benefits from this type of therapy. Hippotherapy may be provided using a horse or a hippotherapy device that mimics a horse in some capacity.

SUMMARY

This disclosure relates generally to a hippotherapy device. In one embodiment, the hippotherapy device is provided for supporting a rider and includes a number of interconnected rider support members. One portion of the rider support members has a first thickness and a second portion of the rider support members has a second thickness. The second thickness is greater than the first thickness. The device includes a frame coupled to the interconnected rider support members and a cam mount. The cam mounts operate a group of cams that interact with the group of interconnected rider support members.

In another embodiment of the disclosure, a hippotherapy device for supporting a rider is provided that includes a plurality of interconnected rider support members each having a generally flat lower surface and an at least partially rounded upper surface. The device further includes a frame coupled to the plurality of interconnected rider support members and a cam mount. The device further includes a first plurality of removable cams being configured to interact with the plurality of interconnected rider support members and are operably coupled with the cam mount. The first plurality of removable cams have a first size. And the device also comprises a second plurality of removable cams being configured to interact with the plurality of interconnected rider support members and are operably coupled with the cam mount. The second plurality of removable cams are interchangeable with the first plurality of cams and have a second size different from the first size.

In another embodiment, a hippotherapy device for supporting a rider is provided that includes a plurality of interconnected rider support members each having a generally flat lower surface and an at least partially rounded upper surface. The device further includes a frame coupled to the plurality of interconnected rider support members and including a cam mount. The cam mounts operate a plurality of cams configured to interact with the plurality of interconnected rider support members. The device also includes a plurality of stoppers located on the upper surface of the frame and arranged to engage a lower mounting member.

BRIEF DESCRIPTION OF THE DRAWINGS

The foregoing aspects and many of the intended features of this disclosure will become more readily appreciated as the same becomes better understood by reference to the following detailed description when taken in conjunction with the accompanying drawing

Figure 1:
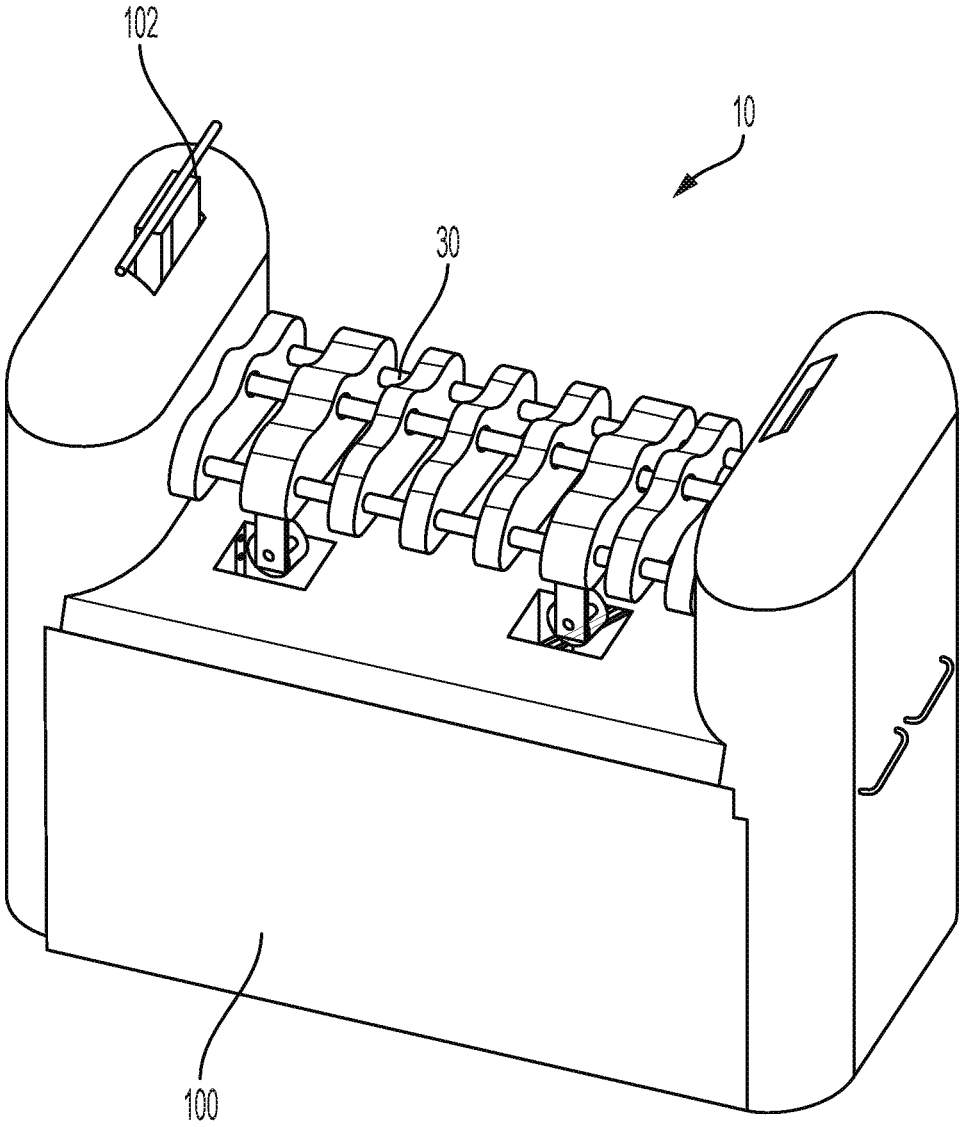
FIG. 1 is a perspective view of a hippotherapy device with an enclosure.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the disclosure, and such exemplifications are not to be construed as limiting the scope of the disclosure in any manner.

DETAILED DESCRIPTION OF THE DRAWINGS

For the purposes of promoting and understanding of the principals of the disclosure, reference will now be made to the embodiments illustrated in the drawings, which are described below. The embodiments disclosed below are not intended to be exhaustive or limit the disclosure to the precise form disclosed in the following detailed description. Rather, the embodiments are chosen and described so that others skilled in the art may utilize their teachings. It will be understood that no limitation of the scope of the disclosure is thereby intended. The disclosure includes any alterations and further modifications in the illustrative devices and described methods and further applications of the principles of the disclosure which would normally occur to one skilled in the art to which the disclosure relates.

Hippotherapy is a rehabilitatory procedure. According to one aspect of hippotherapy, a person strengthens various muscles through motion transfer and muscle stability generated by riding a horse. For various reasons, it is often advantageous to use a device that can simulate the movement a horse's back as it is walking so that hippotherapy can be performed on a person without the need for an actual horse. A hippotherapy device may articulate a seated person in a vertical plane to simulate the undulation of parts of a horse's back while in motion.

Referring to FIG. 1, an embodiment of a hippotherapy device 10 is shown, Device 10 includes a rider mount 30 on which a person sits, an enclosure 100 that covers portions of device 10, and a handle 102 for a rider to grip. The handle 102 may be removable from the device 10.

Figure 2:
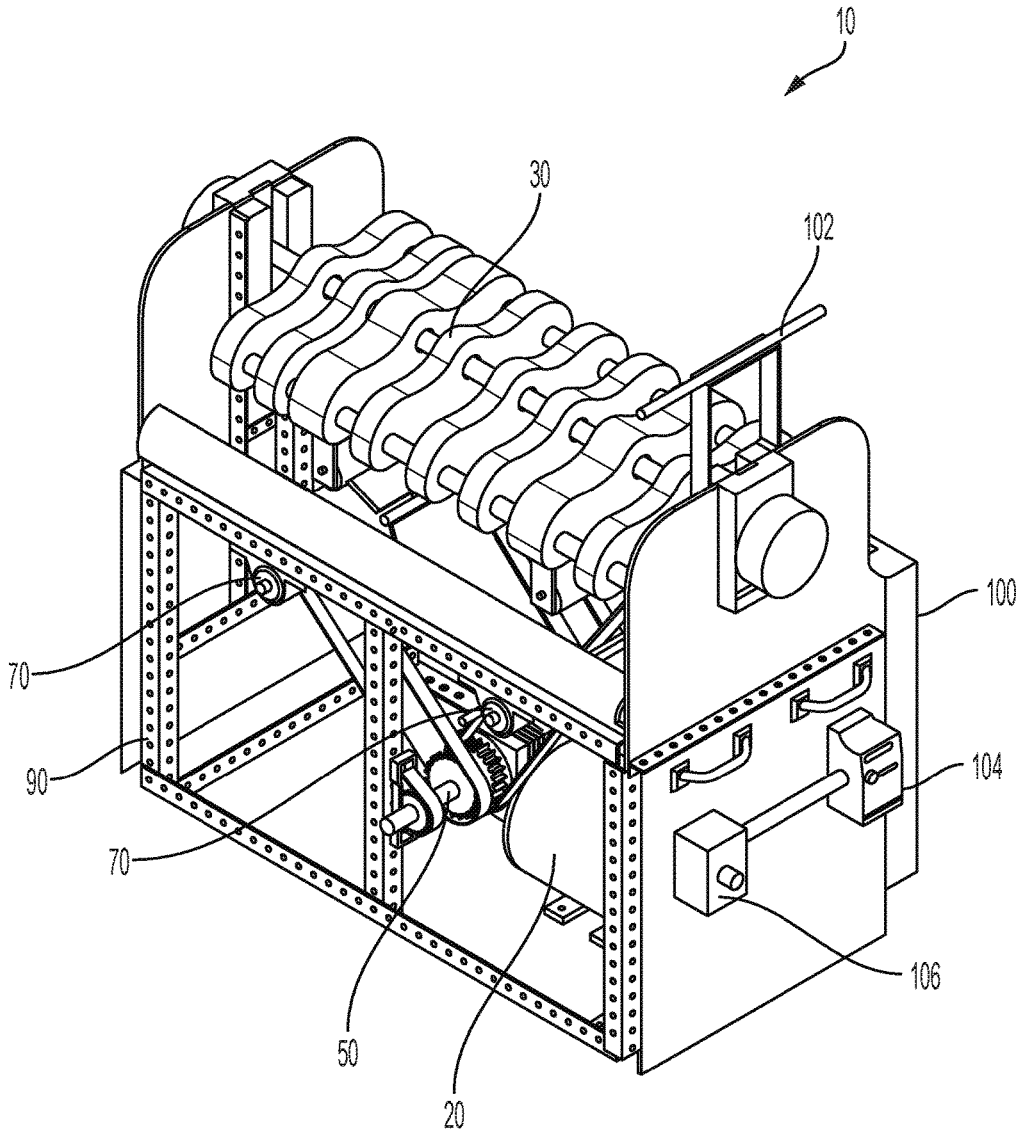
FIG. 2 is a perspective view of a hippotherapy device without an enclosure.

Referring to FIG. 2, device 10 also includes a support frame 90 that supports rider mount 30, cam assemblies 70 that facilitate movement of rider mount 30 through a plurality of cams 60, and drivetrain 50 that controls movement of cam assemblies 70. Device 10 also includes a power source 20, a drivetrain controller 104, and operation controls 106.

In one embodiment, power source 20 is an electric motor. Power for device 10 may also be provided through a manual powering method either by hand or by foot. Further, power source 20 could integrate a variable-frequency drive included in drivetrain controller 104 or something similar that creates different rates for the motor to operate. Power source 20 may also be programmed and may have preprogrammed settings Power source 20 may be mounted anywhere on device 10 including the front, center, and rear of device 10. Additionally, power source 20 may be spaced apart from device 10 and operably coupled thereto through a wired or wireless connection.

Figure 3A:
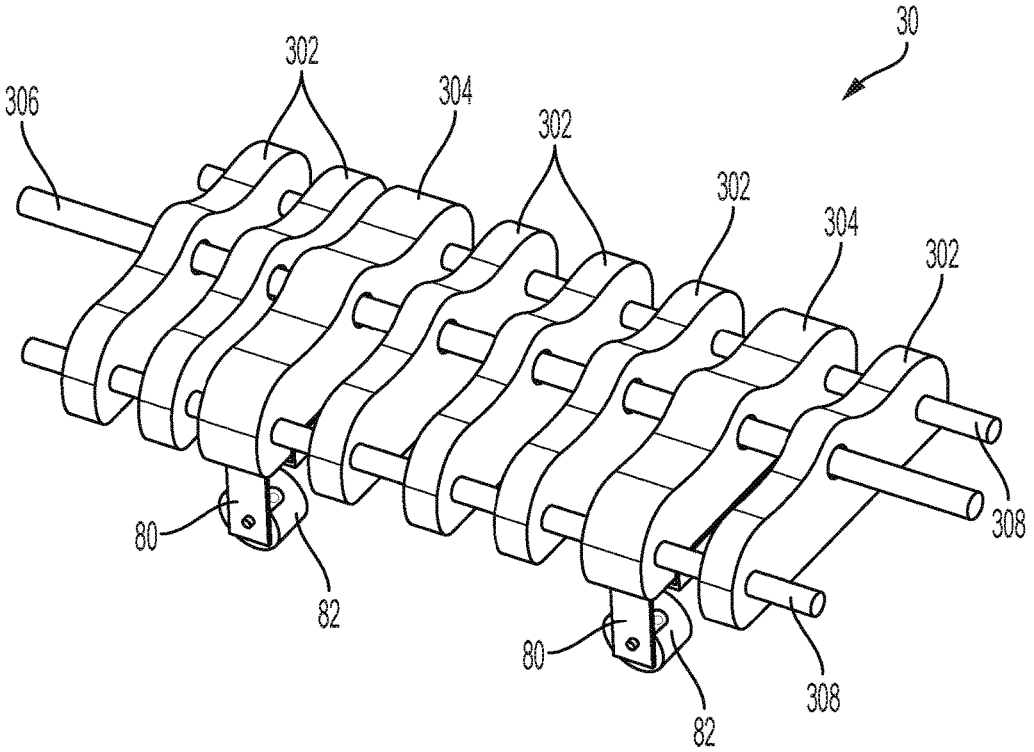
FIG. 3*a* is a perspective view of a rider mount of the hippotherapy device of FIG. 2.

Referring to FIG. 3*a*, one embodiment of rider mount 30 is shown. Rider mount 30 includes narrow ribs 302 which comprise a rolling surface with a first thickness (preferably about 1.0-2.0 inches and, more particularly, approximately 1.4 inches), wide ribs 304, which comprise a second thickness that is about twice the first thickness, tubular backbone 306, rib supports 308, cam follower mounting brackets 80 and cam followers 82. In one embodiment of device 10, cam follower mounting brackets 80 are located on the underside of wide ribs 304. Backbone 306 may be contoured to mimic a horse's back. Narrow ribs 302 and wide ribs 304 are spaced at a predetermined distance along backbone 306 and are further supported and interconnected by rib supports 308. In another embodiment, the backbone 306 may have ridges or dividers that keep the ribs 302, 304 from sliding longitudinally along the backbone 306.

Narrow ribs 302 and wide ribs 304 are both contoured to mimic horse ribs, however, wide ribs 304 have a larger width than narrow ribs 302. The spacing and thickness of narrow ribs 302 and wide ribs 304 are spaced in a manner so that a person can be seated on ribs 302, 304. In some embodiments, a removable padded seat or covering may be secured to rider mount 30 to cover ribs 302, 304 and provide a padded seating surface for the patient when device 10 is in use.

Figure 3B:
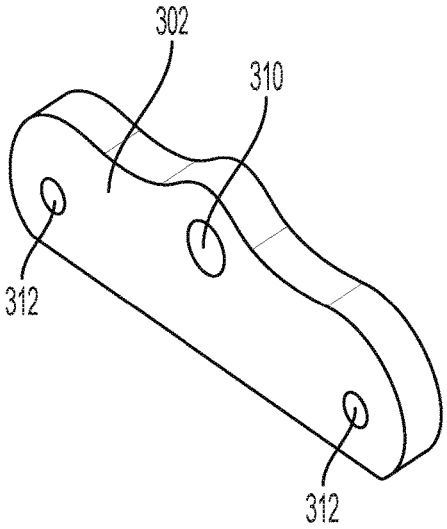
FIG. 3*b* is a perspective view of one of the ribs of the rider mount of FIG. 3*a;*
Figure 3C:
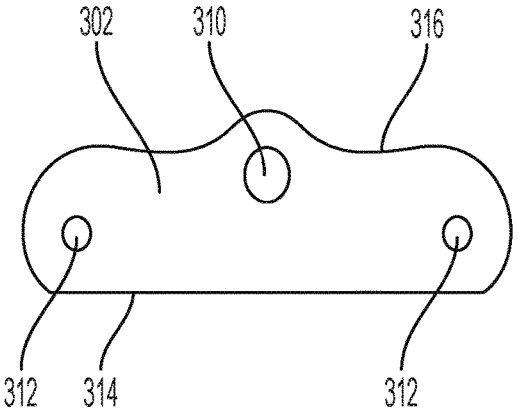
FIG. 3*c* is a front view of the rib of the rider mount of FIG. 3*a;*

FIGS. 3*b* and 3*c* show perspective and front views of narrow rib 302, respectively. Narrow ribs 302 and wide ribs 304 have a through-hole 310 for receiving backbone 306 and a plurality of holes 312 for receiving rib supports 308. Narrow ribs 302 and wide ribs 304 may have a flat bottom 314, and a contoured or rounded top surface 316.

Figure 4A:
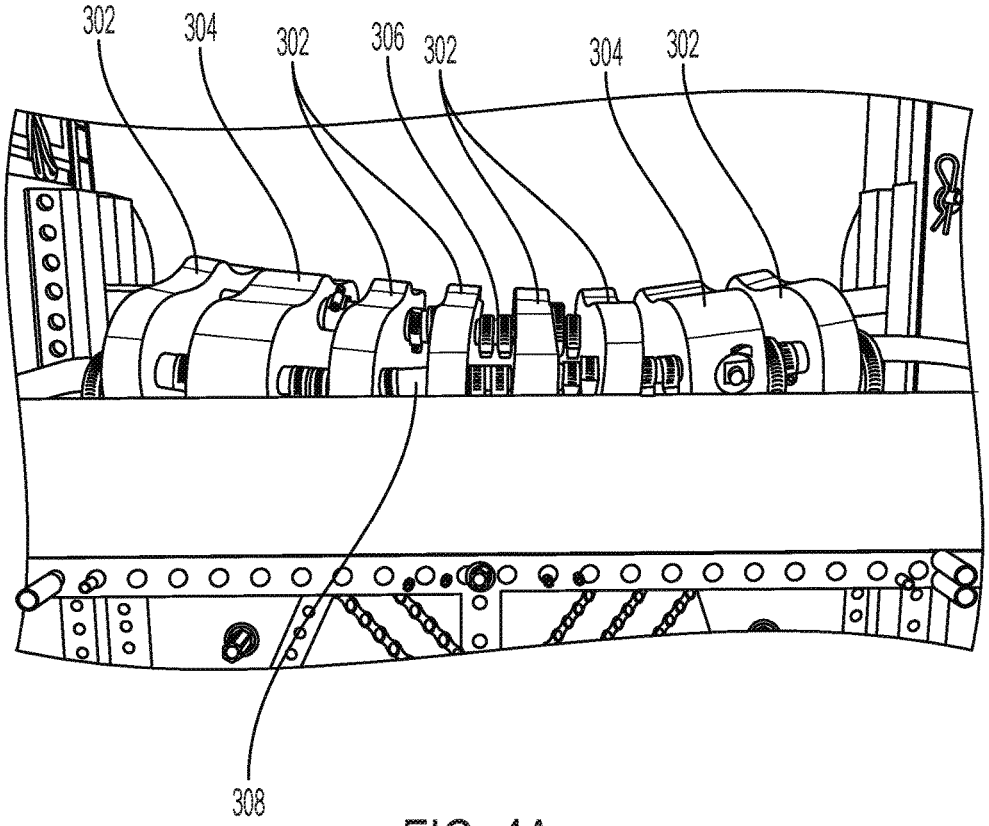
FIG. 4*a* is a side view of the rider mount of FIG. 3*a*, illustrating a curvature of the rider mount.
Figure 4B:
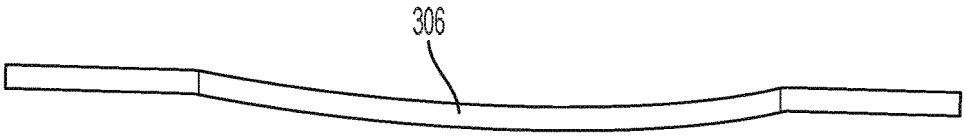
FIG. 4*b* is a side view of a backbone of the rider mount of FIG. 3*a*, illustrating its curvature.

FIGS. 4*a* and 4*b* show one embodiment of rider mount 30, wherein rider mount 30 has a curvature. In particular, backbone 306 may not be linear and may include an arcuate or other contoured profile. In one embodiment, backbone 306 may have a recessed or downward curvature in a middle portion thereof. Because ribs 302, 304 are positioned on backbone 306, device 10 also may include the contour of backbone 306 when ribs 302, 304 are assembled with backbone 306. In this way, device 10 mimics the natural contour of a horse's back to simulate the user being positioned on an actual horse.

Figure 5:
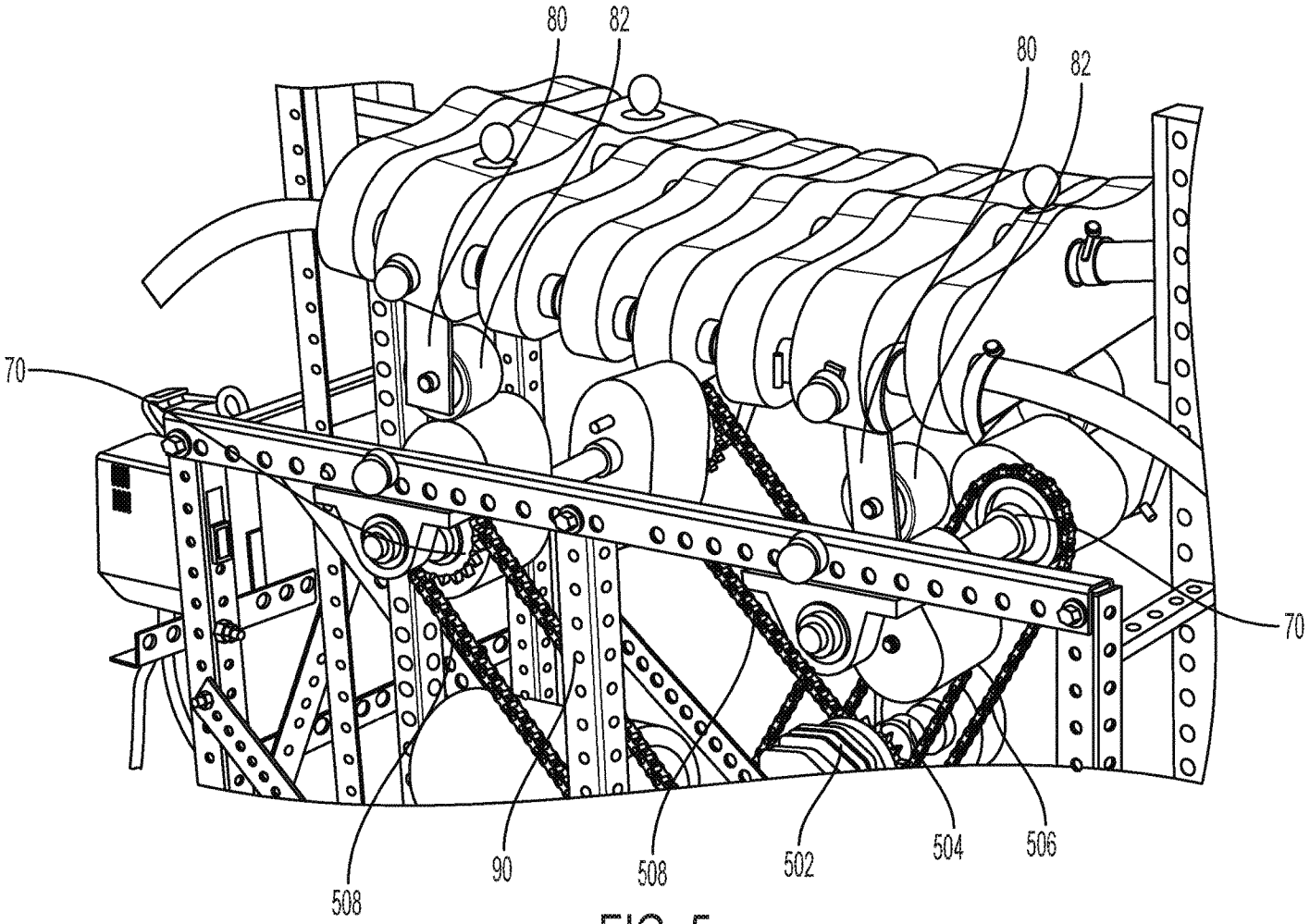
FIG. 5 is a perspective view of a support frame for the rider mount of FIG. 3*a*, showing the rider mount, cams, cam followers, and a drivetrain for the cams and cam followers that actuate the rider mount.

Referring to FIG. 5, one embodiment of drivetrain 50 and cam assemblies 70 of device 10 is shown. Cam followers 82 are attached to cam follower mounting brackets 80, also referred to as a lower mounting member, and interact with cam assemblies 70. Drivetrain 50 includes a three phase inverter motor 502, an input shaft 504, drive sprockets 506, and drive chains 508. Motor 502 is powered by the power source 20 through drive input shaft 504. Drive sprockets 506 are located on and attached to input shaft 504. As input shaft 504 rotates from rotational movement provided by motor 502, drive sprockets 506 also rotate with input shaft 504. Each drive sprocket 506 is connected by one or more drive chain(s) 508 to cam assemblies 70. As drive sprockets 506 rotate, drive chains 508 transfer the rotational motion to cam assemblies 70 so that cam assemblies 70 can drive cams 60, thereby moving cam followers 82. The rotational movement of cams 60 cause cam followers 82 to move in a vertical direction, thereby undulating parts of rider mount 30 in a vertical linear plane. Drivetrain 50, rider mount 30, and cam assemblies 70 may be rigidly attached to support frame 90. A variable frequency drive may be operatively coupled to motor 502 to control rotational speed of cams 60.

According to one aspect of the present disclosure, cams 60 may be removable from device 10. At least one set of cams 60 has a different cam profile from another set of cams 60, The cam profiles may differ in the shape of the profile or the size of the profile. By providing different profiles, the motion of wide ribs 304 and narrow ribs 302 can be varied by replacing one set of cams 60 with another set of cams 60. Each set of cams 60 may have its own associated cam mount. In this way, by making cams 60 removable, cams 60 with different sizes and shapes can be used on device 10 for varying the type and degree of motion the patient experiences when using device 10. For example, as the patient progresses through a course of therapy on device 10, the size and profile of cams 60 may vary to provide more advanced therapies to the patient during specific points in the therapy schedule.

Figure 6A:
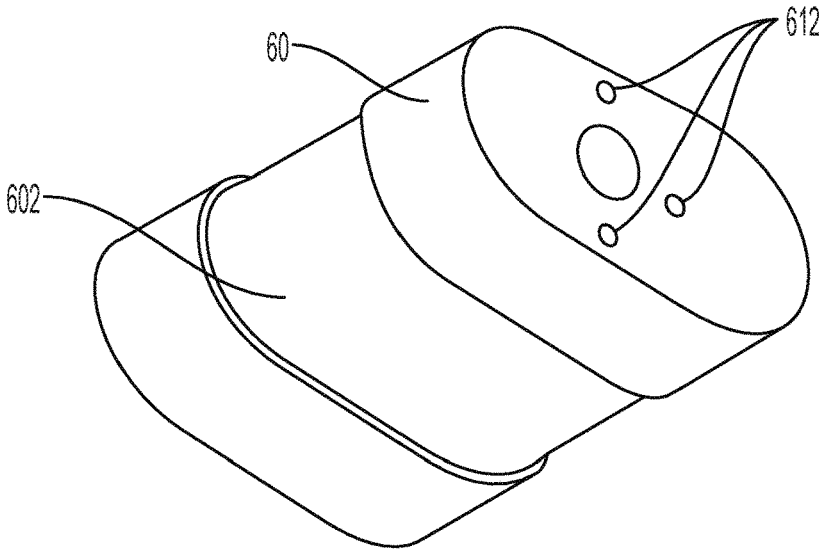
FIG. 6*a* is a perspective view of a grooved cam.
Figure 6B:
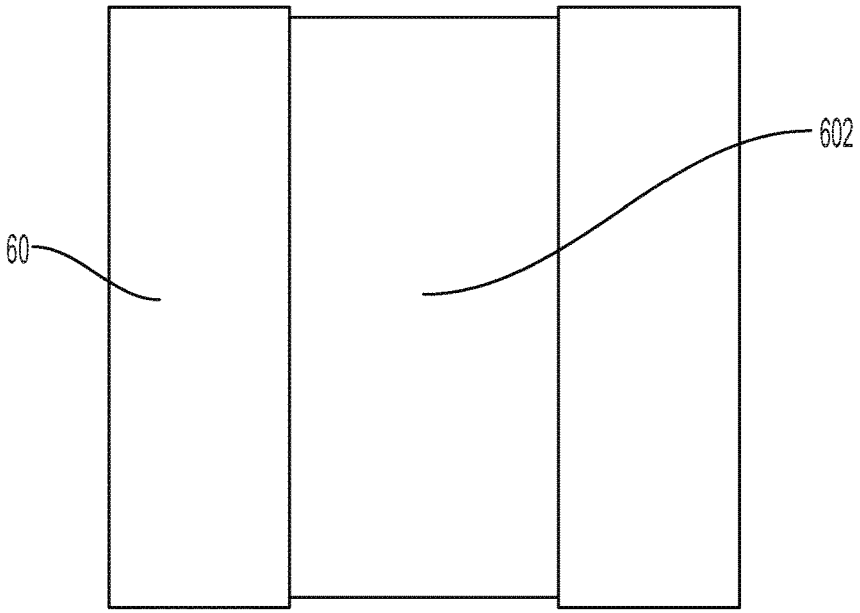
FIG. 6*b* is a top view of the grooved cam of FIG. 6*a;*
Figure 6C:
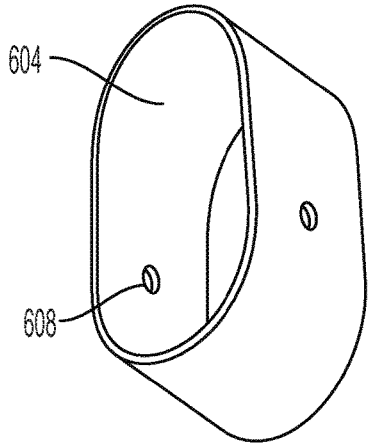
FIG. 6*c* is a perspective view of a smoothing band configured to be positioned on the grooved cam of FIG. 6*a;*
Figure 6D:
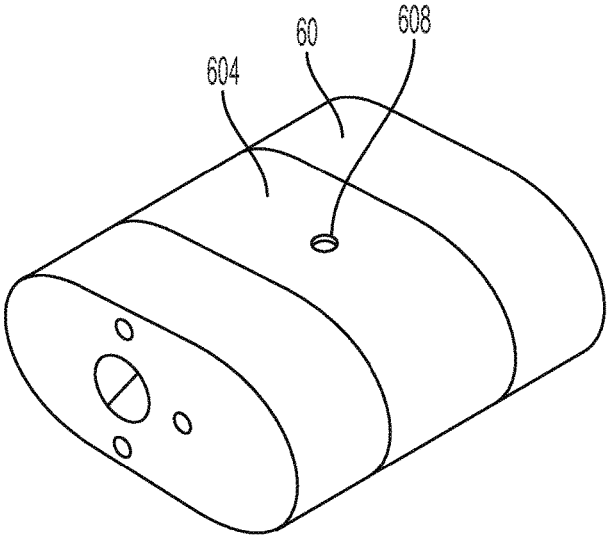
FIG. 6*d* is a perspective view of the grooved cam of FIG. 6*a* assembled with the smoothing band of FIG. 6*c;*
Figure 6E:
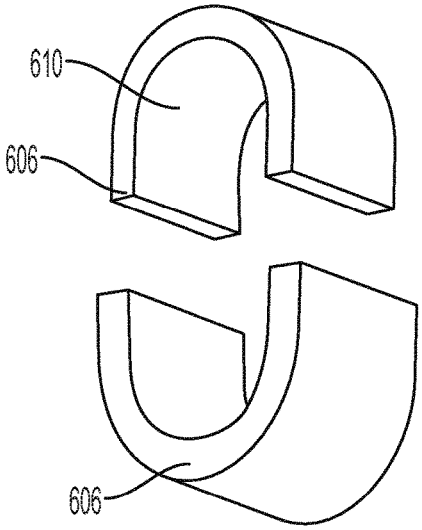
FIG. 6*e* is a perspective view of an expander cam shell configured to be positioned around the grooved cam of FIG. 6*a;*
Figure 6F:
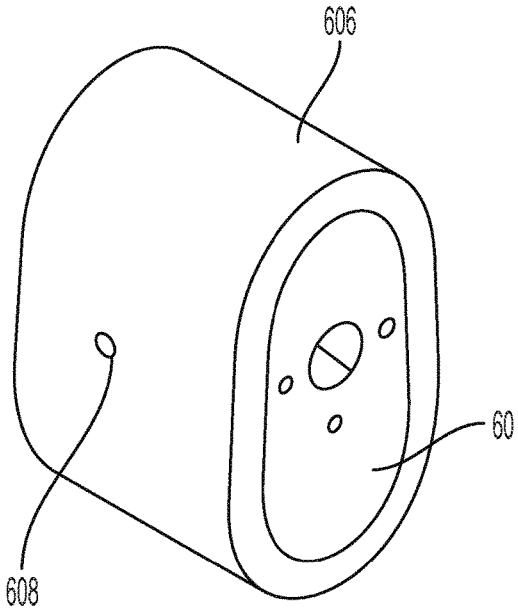
FIG. 6*f* is a perspective view of the grooved cam of FIG. 6*a* assembled with the expander cam shell of FIG. 6*e;*

Referring to FIGS. 6*a* and 6*b*, according to another embodiment, cams 60 may have a groove 602 so as to differ the size of the cross-sectional profile of cams 60. Referring to FIGS. 6*c* and 6*d*, a smoothing band 604 may be positioned within groove 602 such that an outer surface of smoothing band 604 is generally flush with an outer surface of cam 60. Referring to FIGS. 6*e* and 6*f*, in an alternative embodiment, an external cam shell 606 comprising at least one piece may be positioned within groove 602 and enlarge the center profile of cams 60 or may be positioned around the complete outer surface of cam 60, thereby encompassing cam 60. In a further embodiment, cam shell 606 may be positioned around both cam 60 and smoothing band 604 when smoothing band 604 is positioned within groove 602. Smoothing band 604 and external cam shell 606 may be secured to the cam 60 by passing a fastener, such as a screw, through fastener holes 608 on cam shell 606 (FIG. 6*f*).

Figure 7A:
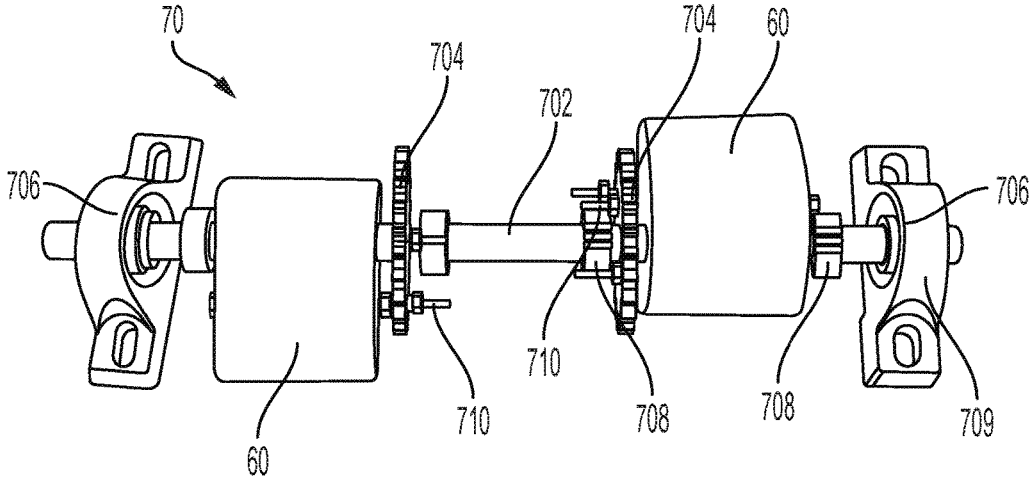
FIG. 7*a* is a perspective view of a camshaft driven by the drivetrain of FIG. 5 includes the cams and cam followers for actuating the rider mount.

Referring to FIG. 7*a*, one of cam assemblies 70 is shown. Cam assembly 70 includes a cam shaft 702, cams 60, a cam sprocket 704, support bearings 706, collars 708, and sprocket attachments 710. Support frame 90 includes collars 709, also referred to as cam mounts, which support cams 60 on support frame 90.

Figure 7B:
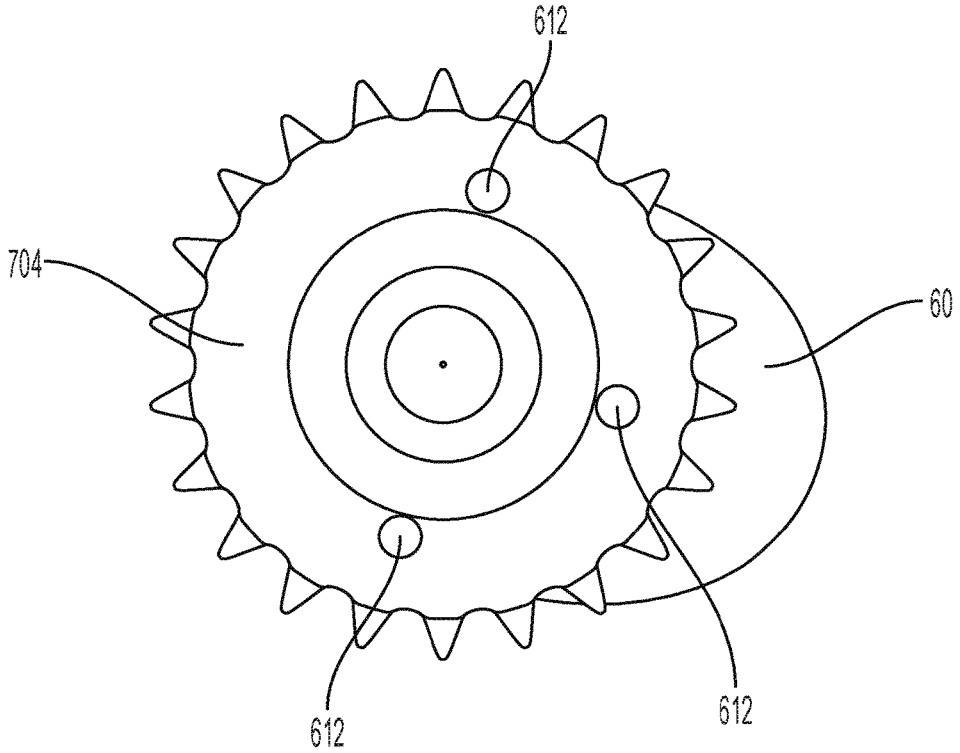
FIG. 7*b* is a side view of the cam and the sprocket assembly of FIGS. 5 and 7*a;*

Cams 60, cam sprockets 704, and collars 708 are positioned on cam shaft 702 so that each cam sprocket 704 is preferably lined up with a singular corresponding drive sprocket 506 and are connected with one of drive chains 508 (FIG. 5). Support bearings 706 are configured to be attached to support frame 90 and may include an internal bearing, for example, a ball bearing, to facilitate smooth rotation of cam shaft 702. FIG. 7*b* shows a side view of cam 60 and cam sprocket 704, which both have holes 612 that are sized to receive sprocket attachments 710 (FIG. 7*a*). In certain embodiments, the different sized cam sprockets 704 may be used to achieve a different rotational rate, thereby defining anew gear ratio. Also, a timing chain or an alternate tensioner may be used in the drivetrain 50 and cam assemblies 70.

Cams 60 can be oriented on cam shaft 702 relative to each other and secured in multiple configurations by collars 708. Through an interaction with cam followers 82, cams 60 transfer the rotational motion of cam shaft 702 to cam followers 82 and cam follower mounting brackets 80, creating vertical linear motion. As shown in FIG. 7*a*, the lobes of each of cams 60 are offset 180 degrees from each other so that right and left sides of respective wide ribs 304 move in opposite vertical directions as cams 60 rotate.

Cam follower mounting brackets 80 are attached to wide ribs 304 and through that connection, portions of wide ribs 304 move vertically. Because of backbone 306 and rib supports 308, wide ribs 304 transfer some, but not typically all, of their motion to other parts of rider mount 30 (ex. narrow ribs 302). Cams 60 are oriented in a manner so that rider mount 30 undulates in a manner that simulates the motion of a horse's back as the horse is walking.

Figure 8A:
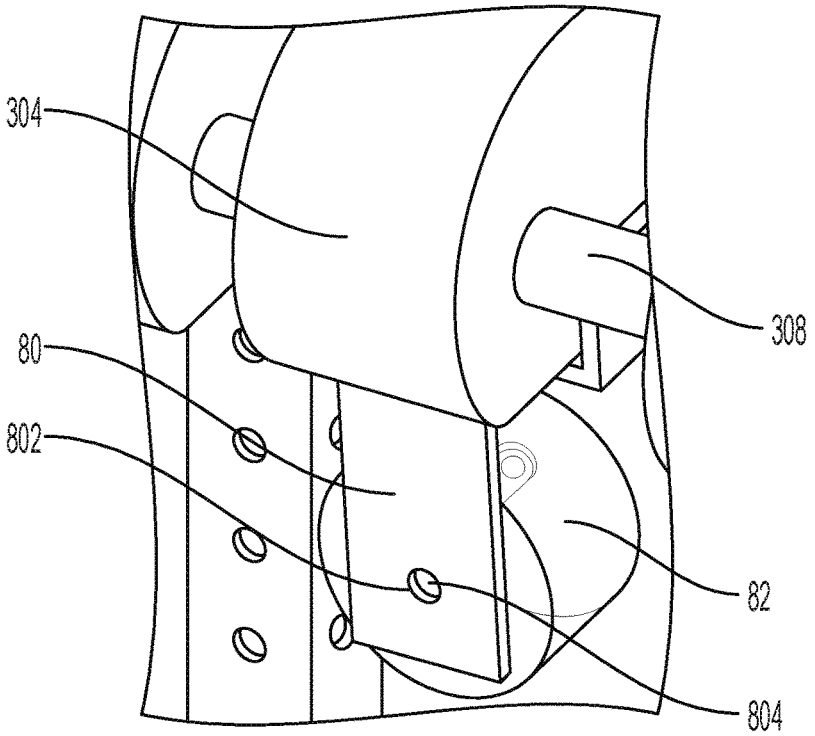
FIG. 8*a* is a perspective view of the cam follower attached to a wide rib of the rider mount.
Figure 8B:
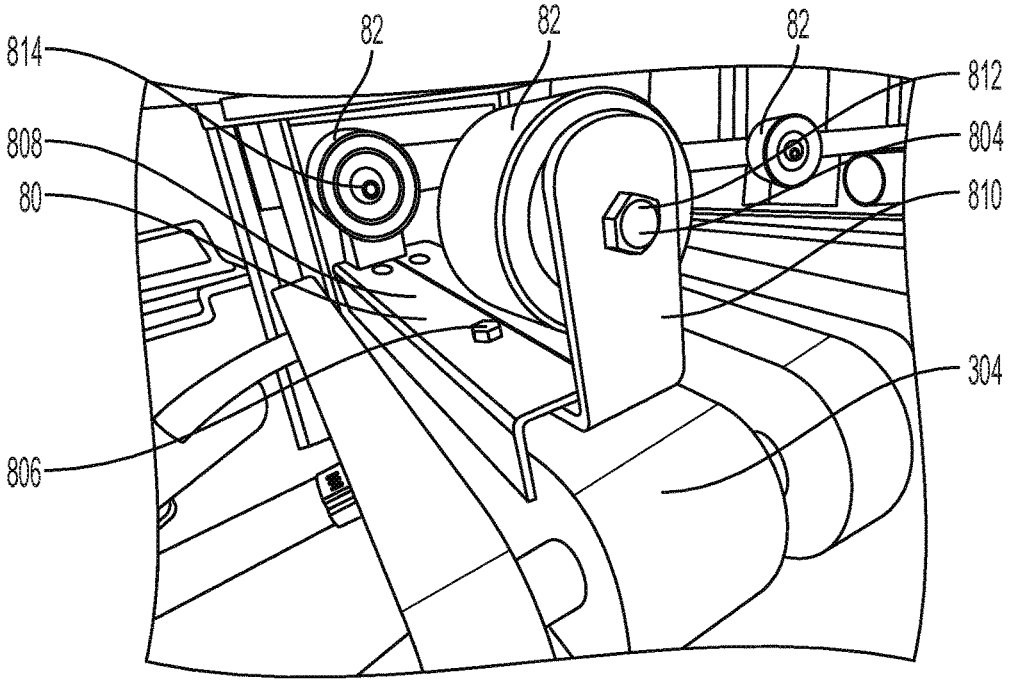
FIG. 8*b* is a further perspective view of the cam follower attached to the rib of the rider mount.

FIGS. 8*a* and 8*b* show an embodiment of the attachment of cam followers 82 to wide rib 304 and cam follower support brackets 80. In an embodiment of device 10, cam follower support brackets 80 include a pair of L-shaped brackets 808 spanning a length of bottom 314 of wide rib 304, a pair of side brackets 810, and a plurality of follower mounting holes 802. L-shaped brackets 808 are attached to bottom 314 of wide rib 304 by a bracket attachment 806. Cam followers 82 are attached to support brackets 80 through follower attachments 804, which are configured to pass through follower mounting holes 802 on side brackets 810. In one embodiment of device 10, follower attachments 804 comprise a bolt 812 passing through follower mounting hole 802 and cam follower 82, and a nut 814 threaded on bolt 812.

In another embodiment, cam followers 82 may differ in size no as to create varying motions in the rider mount 30.

Figure 9:
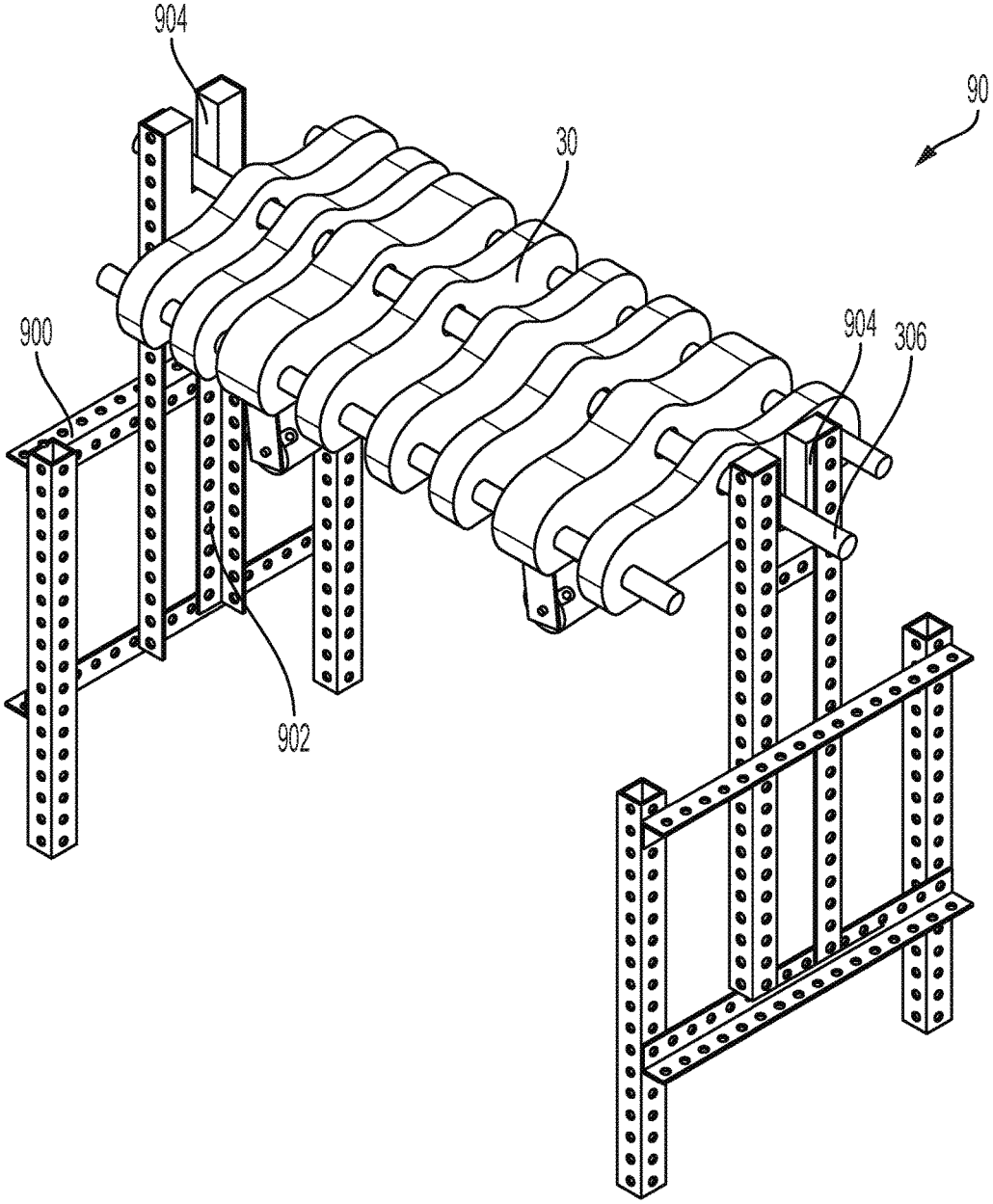
FIG. 9 is a perspective view of an alternative support frame coupled to the rider mount of FIG. 3*a;*

Referring to FIG. 9, rider mount 30 and portions of support frame 90 are shown. Support frame 90 comprises a plurality of support members 900 that may have different configurations. Support members 900 may include a plurality of holes 902, which, collectively, may span the length the support members 900. Support frame 90 also comprises two U-shaped channels 904. Channels 904 may be located at the topmost point of support frame 90 and are wide enough to allow for backbone 306 to be seated. As vertical linear motion is transferred to wide ribs 304, channels 904 allow for backbone 306 to move vertically, but remain fixed horizontally.

Figure 10:
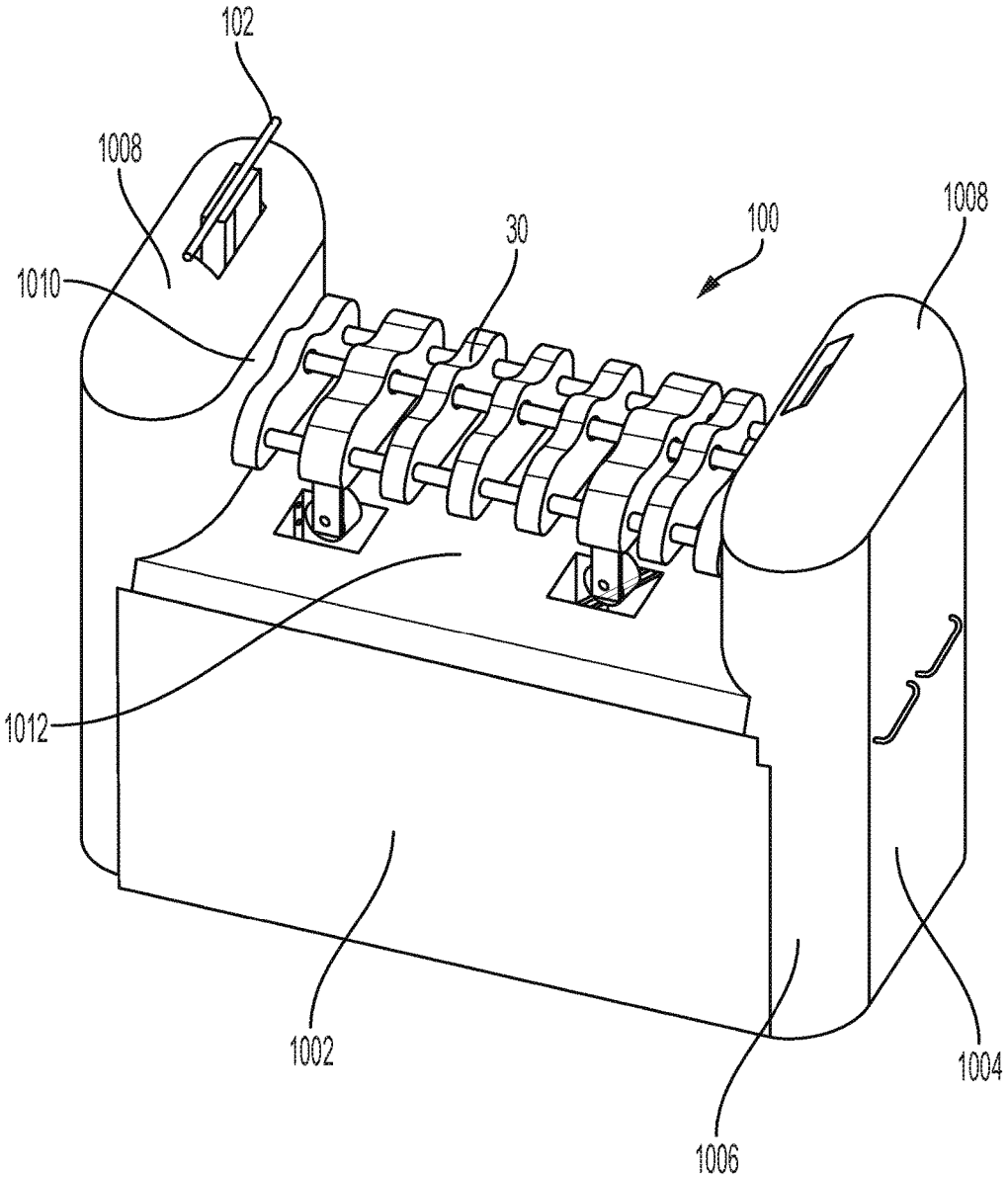
FIG. 10 is a perspective view of an enclosure for the support frame of FIG. 9.

Referring to FIG. 10, enclosure 100 of device 10 surrounds support frame 90 to block access to support frame 90. Enclosure 100 includes side walls 1002, front wall 1004, corner panels 1006, mount walls 1008, back wall 1010, and interior covering 1012. Interior covering 1012 is attached to the support frame 90 and below rider mount 30 so that a rider's legs are blocked from drivetrain 50 and cam assemblies 70 when in operation. Mount walls 1008 are rigidly attached to the front and back of support frame 90 and rib supports 308 when in operation.

Figure 11:
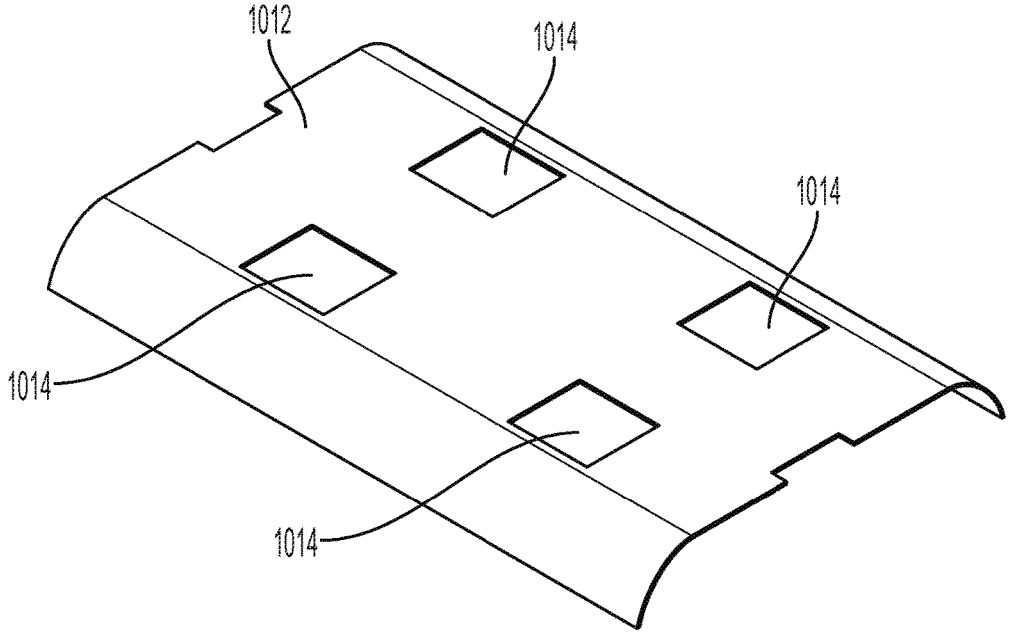
FIG. 11 is a perspective view of an interior covering of the enclosure of FIG. 10.

Referring to FIG. 11, interior covering 1012 is shown. In one embodiment, the interior covering 1012 may have a plurality of access holes 1014 that enable the cam assemblies 70 to extend through while also providing protection to the rider's legs.

Figure 12:
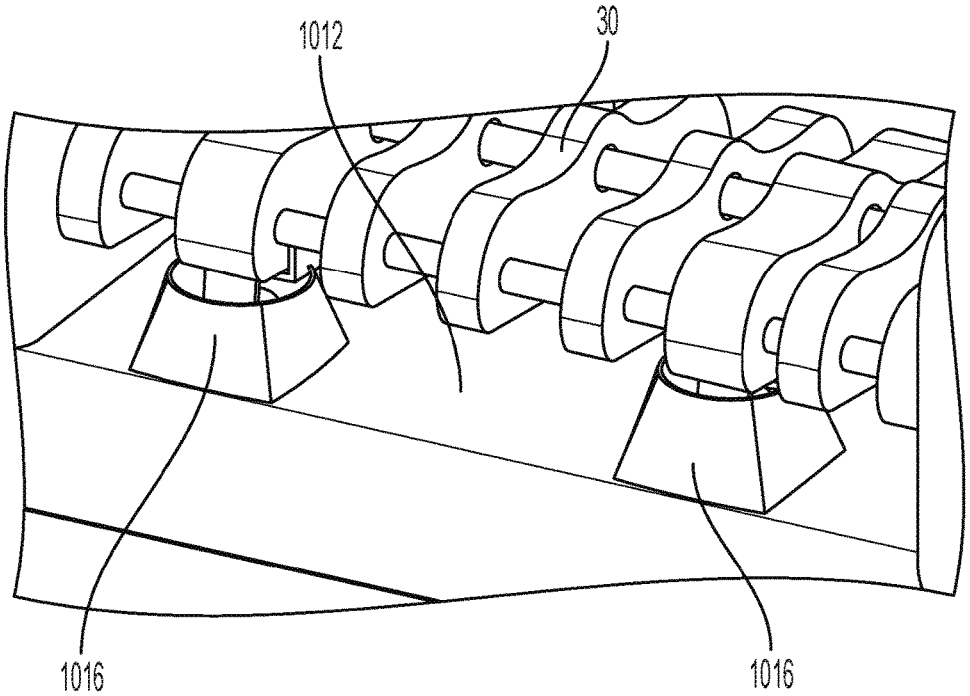
FIG. 12 is a perspective view of a cam blocker shielding the cams and cam followers' interaction beneath the ribs.

Referring to FIG. 12, in another embodiment there may be cam blockers 1016 attached to interior covering 1012 to prevent hands, feet, or other objects from coming into contact with the cam follower support brackets 80 and cam followers 82.

Figure 13:
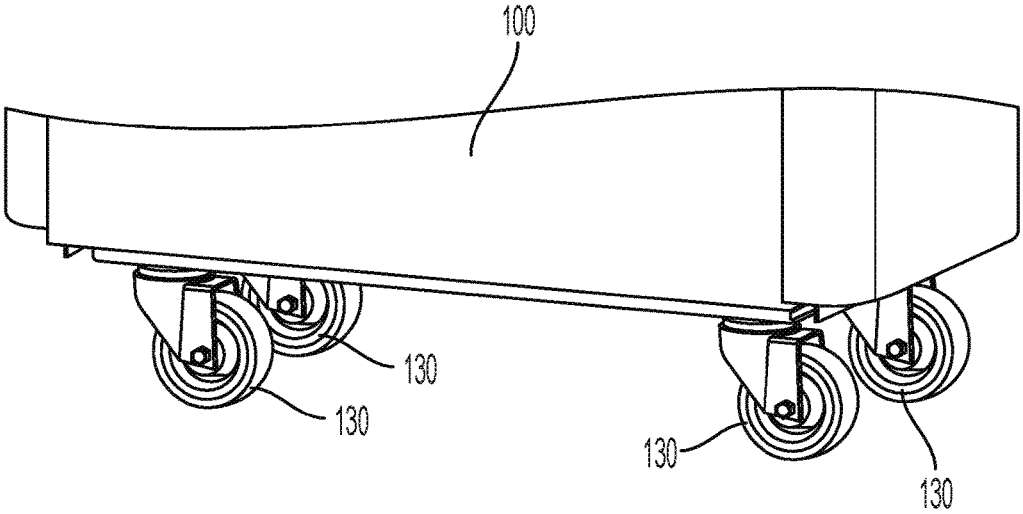
FIG. 13 is a perspective view of wheels coupled to the support frame for wheels.

FIG. 13 shows an embodiment of wheels 130 attached to support frame 90. Wheels 130 provide for easy transportability and may also include a locking mechanism which provides stability during operation by preventing rotation of wheels 130 in a locked position.

Figure 14A:
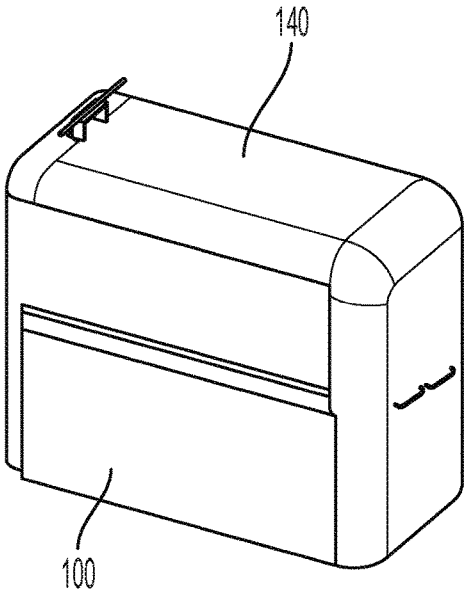
FIG. 14*a* is a perspective view of the hippotherapy device with an enclosure from FIG. 1 and an exterior shell case configured to couple with the enclosure.
Figure 14B:
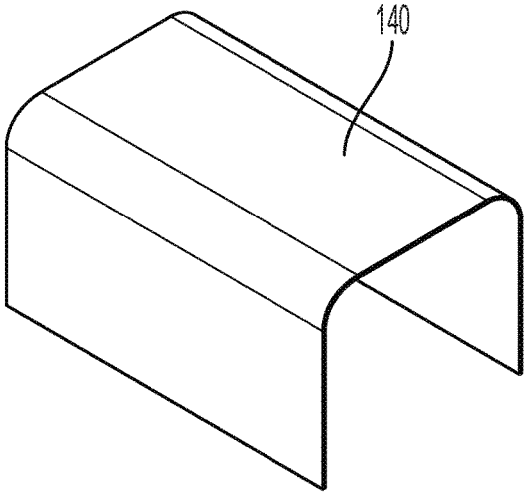
FIG. 14*b* is a perspective view of the exterior shell case of FIG. 14*a*.

Referring to FIGS. 14*a* and 14*b*, one embodiment shows an exterior shell case 140 that cooperates with enclosure 100 to cover rider mount 30. Exterior shell case 140 together with the enclosure 100 protect the device 10.

Figure 15:
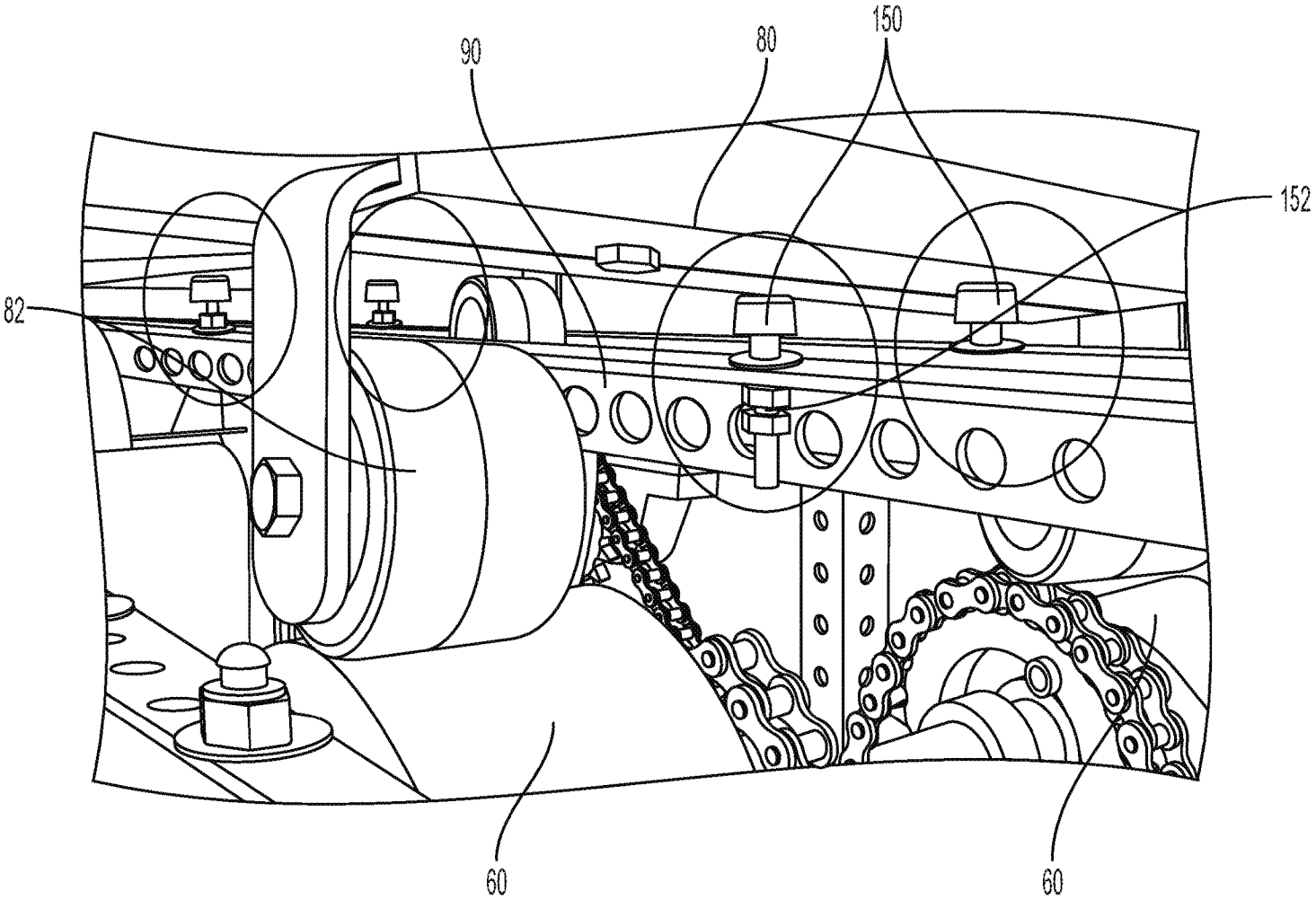
FIG. 15 is a perspective view of a load distribution mechanism attached to the support frame to decrease the likelihood of the ribs contacting the support frame.

Referring to FIG. 15, to assist wide ribs 304 in avoiding contact with support frame 90, load distribution mechanisms or stoppers 150 may be rigidly attached to support frame 90 through load distribution attachments 152 in one embodiment. Stopper attachments 152 may be configured to be placed through holes 902 on support frame members 900 (FIG. 9). As cams 60 interact with cam followers 82, cam follower mounting bracket 80 is lifted off of stoppers 150. As cam followers 82 are lowered, cam follower mounting bracket 80 is lowered back down, and is stopped from making contact with support frame 90 by stoppers 150.

In one embodiment, lower mounting member 80 may also serve as a load distribution mechanism if lower mounting member 80 comprises a partially shock absorbent material, such as rubber. With such a material composition, lower mounting member 80 could contact the upper surface of support frame 90 and serve the similar purpose of stoppers 150. In another embodiment, stoppers 150 may be mounted to cam follower mounting bracket 80, also referred to as the lower mounting member, instead of to support frame 90. Stoppers 150 may be arranged on lower mounting member 80 so that stoppers 150 contact the upper surface of support frame 90.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practices in the art to which this disclosure pertain.

I claim:

1. A hippotherapy device for supporting a rider, comprising:

a plurality of interconnected rider support members each having a generally flat lower surface and an at least partially rounded upper surface;

a frame coupled to the plurality of interconnected rider support members and including a cam mount;

a first plurality of removable cams being configured to interact with the plurality of interconnected rider support members and are operably coupled with the cam mount, the first plurality of removable cams having a first size; and a second plurality of removable cams being configured to interact with the plurality of interconnected rider support members and are operably coupled with the cam mount, the second plurality of removable cams being interchangeable with the first plurality of cams and having a second size different from the first size.

2. The device of claim 1, wherein the plurality of interconnected rider support members are at least partially comprised of wood.

3. The device of claim 1, wherein the plurality of interconnected rider support members is comprised of a first material and includes a lower mounting member comprised of a second material configured for shock absorption.

4. The device of claim 1, further comprising at least one tubular member extending through a portion of the rider support members and configured to move in a generally vertical direction.

5. The device of claim 1, further comprising a first plurality of cam followers each configured to engage one of the first plurality of removable cams and a second plurality of cam followers each configured to engage one of the second plurality of removable cams.

6. The device of claim 5, wherein the first and second pluralities of cam followers have a rolling surface thickness of at least 1.0 inches.

7. The device of claim 5, wherein the plurality of rider support members includes a first portion of rider support members having a first thickness and second portion of rider support members having a second thickness greater than the first thickness, and the first and second pluralities of cam followers are coupled to the second portion of rider support members.

8. The device of claim 1, further comprising of a drive-train configured to control rotational speed of the plurality of first and second pluralities of cams.

9. A hippotherapy device for supporting a rider, comprising:

a plurality of interconnected rider support members each having a generally flat lower surface and an at least partially rounded upper surface;

a frame coupled to the plurality of interconnected rider support members and including a cam mount;

a plurality of cams configured to interact with the plurality of interconnected rider support members and are operably coupled with the cam mount; and a plurality of stoppers located on the upper surface of the frame and arranged to engage a lower mounting member.

10. The device of claim 9, wherein each of the plurality of stoppers are at least partially comprised of rubber.

11. The device in claim 9, further comprising at least one tubular member extending through a portion of the rider support members and configured to move in a generally vertical direction.

12. The device of claim 9, further comprising a plurality of cam followers coupled to at least one bracket, and the at least one bracket is coupled to at least one rider support member.

13. The device of claim 12, wherein the plurality of rider support members includes a first portion of rider support members having a first thickness and second portion of rider support members having a second thickness greater than the first thickness, and the plurality of cam followers are coupled to the second portion of rider support members.

14. The device of claim 9, wherein the plurality of cams are removable.

15. The device of claim 9, wherein the frame is located vertically between the plurality of rider support members and the plurality of cams.

* * * * *